United States Patent [19]

Wever

[11] Patent Number: 4,854,203

[45] Date of Patent: Aug. 8, 1989

[54] CONTINUOUS MOTION PERFORATOR

[75] Inventor: Albrecht Wever, Bergen, N.Y.

[73] Assignee: Eastman Kodak Company, Rochester, N.Y.

[21] Appl. No.: 223,816

[22] Filed: Jul. 25, 1988

[51] Int. Cl.[4] ..... B26F 1/06

[52] U.S. Cl. ..... 83/321; 83/345; 83/326; 83/660; 83/667

[58] Field of Search ..... 83/647.5, 660, 345, 83/308, 670, 665, 344, 321, 326

[56] References Cited

U.S. PATENT DOCUMENTS

| | | | |
|---|---|---|---|
| 1,189,093 | 6/1916 | Gompf . | |
| 1,559,987 | 11/1925 | Reinhardt | 83/345 X |
| 2,261,315 | 4/1941 | Thorsen . | |
| 3,171,314 | 3/1965 | Arndt | 83/326 |
| 3,355,974 | 12/1967 | Carmichael | 83/171 |
| 3,661,044 | 5/1972 | Duden et al. | 83/100 |

*Primary Examiner*—Donald R. Schran

*Attorney, Agent, or Firm*—G. Herman Childress

[57] ABSTRACT

A perforator has an inner drum positioned within an outer drum. The drums define a nip through which a web of photographic film or other material is fed for forming perforations in the web by punches and dies on the drums. The dies are formed in a strip carried by the outer drum, and the punches are on disks on the inner drum. The die strip and disks are easily replaced when the dies and punches become worn.

9 Claims, 3 Drawing Sheets

CONTINUOUS MOTION PERFORATOR

BACKGROUND OF THE INVENTION

The present invention relates to a continuous motion perforator and, more particularly, to a high speed, reliable perforator suitable for perforating photographic film, paper or other webs.

Perforators of various types are well known, including perforators suitable for forming perforations in photographic film, paper or the like. When perforating photographic film, for example, the perforations must be formed with great accuracy and reliability, and positioned exactly in a desired location in order to function properly in a variety of cameras, film processors, and the like. At the same time, such film perforators should be easy to maintain in operation condition, including repair or replacement of the punch and die elements used for forming the perforations. It is also important that the perforator be capable of operating at very high speeds in order to reduce costs and achieve the high production rates required in modern manufacturing facilities.

SUMMARY OF THE INVENTION

Accordingly, it is an object of the invention to provide an improved perforator suitable for use with photographic film or the like which can accurately and reliably form perforations at a high rate of productivity. Another object of the invention is to provide such a perforator wherein the punch and die elements that are subject to wear are easily and quickly replaced, and at a relatively low cost.

A continuous motion perforator in accordance with the present invention has a first drum with a cylindrical inner surface that defines an opening. A second drum has a generally cylindrical outer surface with a diameter that is smaller than the diameter of the surface of the first drum. A plurality of punches and dies are located on the surfaces, and the second surface is positioned within the opening of the first drum with the axis of the surface of the second drum being offset from and parallel to the axis of the surface of the first drum, and with the surfaces being located so that the punches can enter the dies in response to movement of the drums. Means are provided for rotating the drums in the same direction about their respective axes so that the punches enter the dies in response to the rotation of the drums. A web fed between the surfaces is perforated by the punches and dies.

The invention and its objects and advantages will become more apparent in the detailed description of the preferred embodiment presented below.

BRIEF DESCRIPTION OF THE DRAWINGS

In the detailed description of the preferred embodiment of the invention presented below, references made to the accompanying drawing, in which.

DETAILED DESCRIPTION OF THE INVENTION

Figure 1:
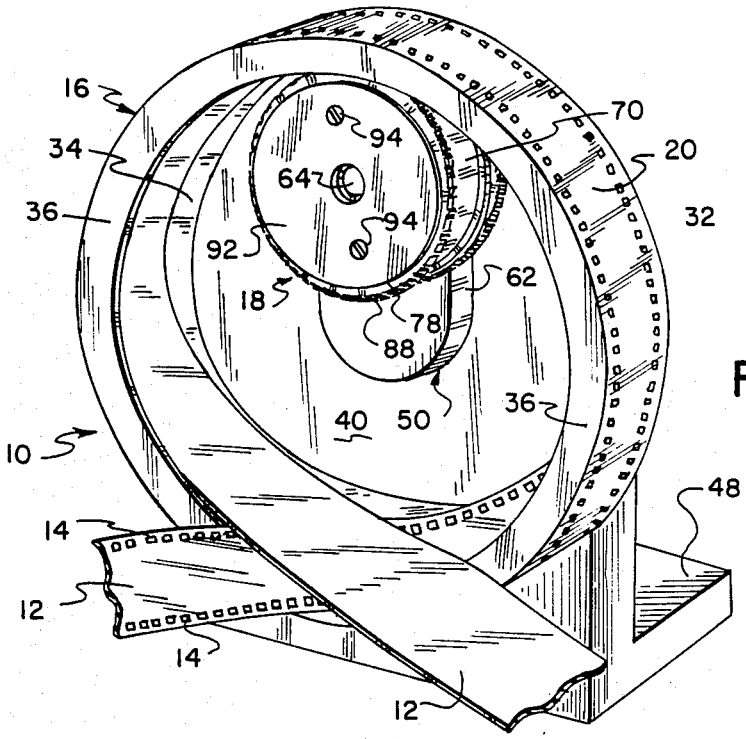
FIG. 1 is a perspective view of a preferred embodiment of a continuous motion perforator of the present invention.

Referring now to the drawings in detail, a preferred embodiment of a continuous motion perforator of the invention is generally designated 10. The perforator receives an elongated strip of web material 12, such as photographic film, and forms rows of perforations 14 along side edges of the web. Generally, perforator 10 comprises an outer drum 16 and a smaller inner drum 18 that is positioned within a cylindrical space in the outer drum. The two drums define a nip within the outer drum. The web 12 has a loop that enters the inner drum through the space below inner drum 18 and then passes through the nip between the drums where the perforations 14 are formed. Then the web leaves the space between the drums.

Figure 3:
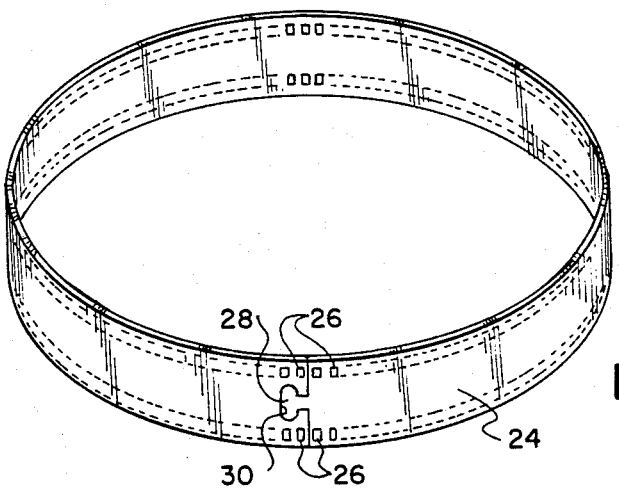
FIG. 3 is a view of the die member of the perforator shown coiled into a cylindrical position which it occupies in the perforator.
Figure 4:
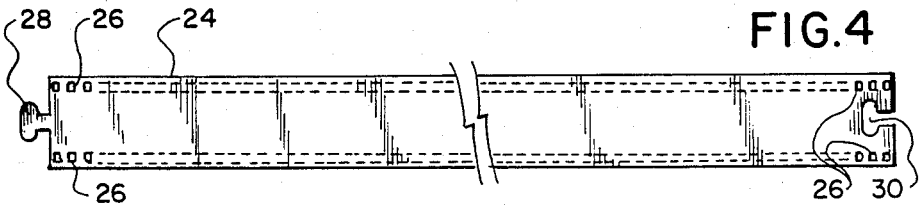
FIG. 4 is a plan view of the die member before it is coiled into the shape shown in FIG. 3.
Figure 2:
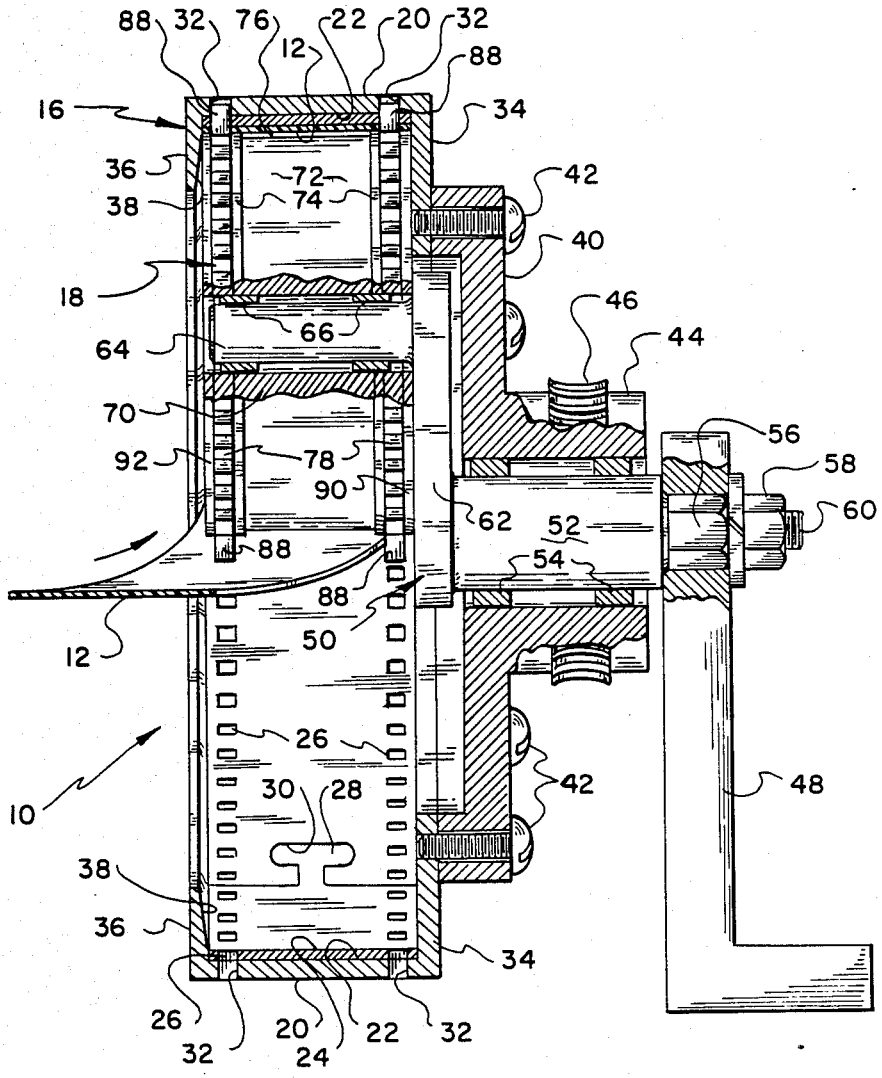
FIG. 2 is a vertical cross section through the perforator of FIG. 1.

Referring to FIGS. 2–4, outer drum16 comprises a generally annular wall member 20 forming a die chase. Member 20 has an inner cylindrical surface 22 that defines an opening in which the outer drum 18 is located. Positioned within the opening and seated against the surface 22 is a die strip generally designated 24. Strip 24 has a plurality of openings 26 comprising dies for forming perforations in the web 12 as explained in more detailed later. As best shown in FIGS. 3 and 4, the perforations 26 preferably are arranged in two parallel rows closely adjacent the side edges of strip 24. The die strip canbe formed, for example, from ground flat tool steel stock. Preferably the die strip is thin and flexible and substantially the width of surface 22.

The strip has a tongue 28 projecting from one end portion thereof and a correspondingly shaped groove 30 in the other end portion thereof. Thus the die strip is initially formed in a flat configuration, as shown in FIG.4, and then bent into a cylindrical shape illustrated in FIG. 3 with the tongue 28 inserted in the groove 30. Strip 24 is of such a length that when formed into the cylindrical shape shown in FIG. 3, it fits within and contacts the cylindrical surface 22. The natural tendency of the strip 24 to return to its flat shape holds it in firm contact against surface 22. When positioned against surface 22, the openings 26 in the die strip are aligned with corresponding rows of die openings 32 in member 20. This enables pieces of the web material 12 removed during perforation operations to pass through the openings 26, 32 in the die strip and member 20 and be removed from the area of the perforator.

Projecting radially inwardly from the side edges of member 20 are an inner annular wall 34 and an outer annular wall 36 of the outer drum. The portions of these walls immediately adjacent surface 22 are separated by a distance substantially equal to the width of die strip 24 to thereby positively locate the strip laterally relative to the surface 22 and openings 32. The web is positioned between walls 34, 36 as explained later.

The radially inner edge of wall 36 provides a circular opening for the web to enter and leave the perforator. The inner surface 38 of wall 36 tapers outwardly from its radially outer edge to the radially inner edge thereof. This tapered surface is engaged by the left edge of web 12 (as viewed in FIG. 2) as the web enters the opening defined by surface 22. Thus the web is guided into lateral alignment with the die strip 24 so that the web is accurately positioned as it enters the nip between outer drum 16 and inner drum 18 for perforation. The radially inner edge of wall 36 has a relatively large diameter thus forming a large circular opening through one end of drum 16 into the space within the drum. The web enters and leaves the perforator through this opening.

An annular wall 40 is attached to the wall 34 by a plurality of screws 42. A hub 44 projects from the radially inner portion of wall 40, and a gear 46 is mounted on the hub 44. Gear 46 is coupled to a drive mechanism (not shown) for rotating hub 44 and thus the outer drum 16.

Drums 16, 18 are supported at a work station in any suitable manner. For example, in the illustrated embodiment the drums are supported from a bracket 48 by a mounting member generally designated 50. Hub 44 is mounted for rotation about the axis of a cylindrical portion 52 of the mounting member by bearings 54. A hexagonal portion 56 of the mounting member projects through a correspondingly shaped opening in bracket 48, and the mounting member is secured in place on the bracket by a nut 58 which is threaded onto end portion 60 of the mounting member.

The mounting member 50 has an arm 62 that extends upwardly from the left end of the cylindrical portion 52. A shaft 64 projects from the upper end of arm 62, and bearings 66 support the inner drum 18 for rotation about the axis of shaft 64. The axis of shaft 64 is offset from the axis of portion 52 of mounting member 50 about which drum 16 rotates. The axes of cylindrical portion 52 and shaft 64, and thus the axes of the drums, are parallel to each other.

Figure 5:
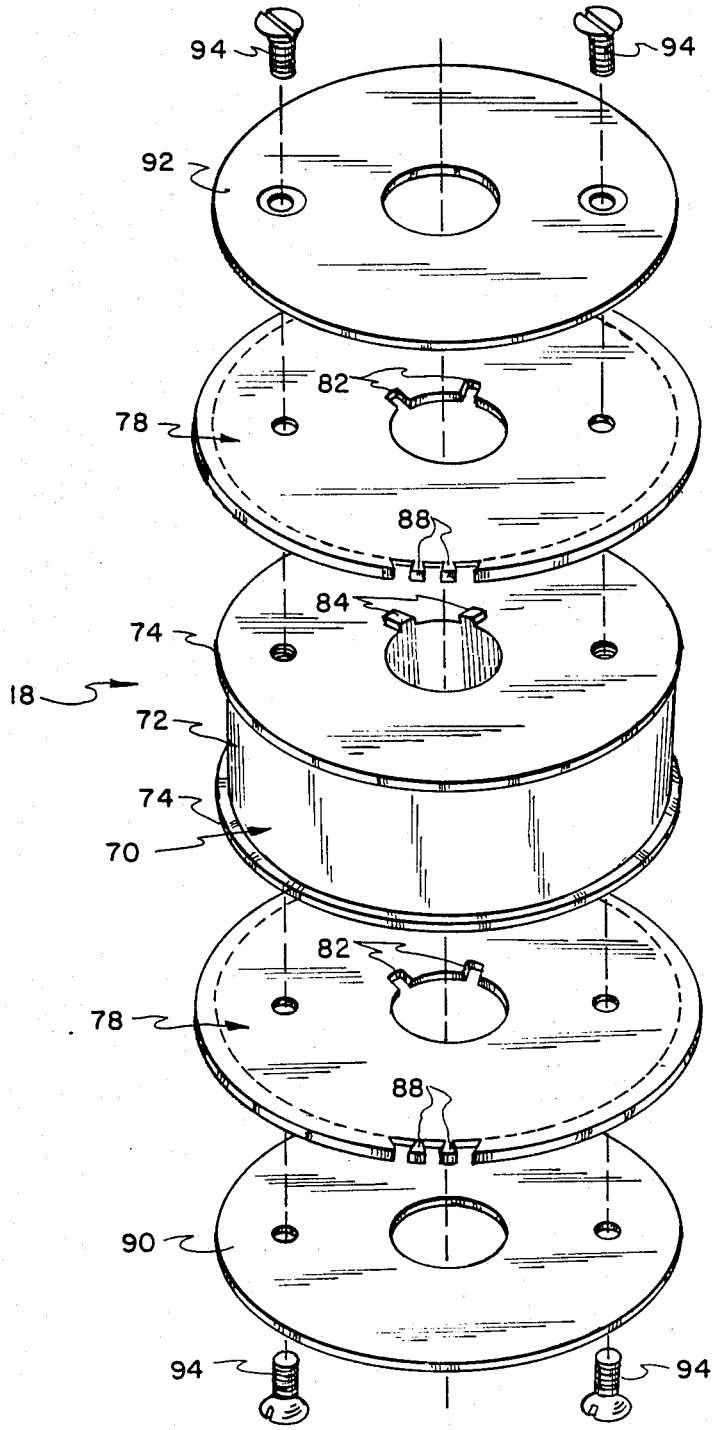
FIG. 5 is an exploded view of the inner drum of the perforator.

Referring now to FIGS. 2, and 5, inner drum 18 comprises a hub portion 70 that is rotatable about bearings 66. The hub has an outer generally cylindrical surface 72 with a diameter that is smaller than the diameter of the inner surface 22 of member 20. In the preferred embodiment illustrated in the drawings, the diameter of surface 72 is about one-half the diameter of the surface 22. Shaft 64 mounts the inner drum 18 in a position relative to the outer drum so that a nip is formed by the two drums at the upper portion of the drums.

The web 12 passes between the two drums in the nip area as shown in FIGS. 1 and 2. A pair of raised edges 74 on opposite sides of the hub surface 70 may contact side edge portions of web 12 and hold the web against die strip 24 in the area adjacent openings 32. Edges 74 leave a small space 76 (FIG. 2) between the hub surface 72 and the inner surface of the web 12. This is important when perforating webs such as photographic film because space 76 prevents contact between the emulsion side of the film and surface 72 to avoid scratching of the film. Other means can be used for urging the web into contact with the die strip. For example, a vacuum plenum can be positioned against the radially outer surface of member 20 opposite the nip between the drums to suck the web against the die strip.

Two annular disks 78 are positioned along the sides of the hub 70. The disks 78 have keyways 82 which receive keys 84, on hub 70 for locating the disks on the hub. The keys and keyways are located a short angular distance apart so that the disk can be positioned in only one orientation with respect to the hub 70. Disks 78 each have a plurality of projecting teeth 88. The teeth comprise punches that pass through the web 12 and enter the openings 32 in member 22 for perforating the web.

A pair of cover plates 90, 92 are positioned against the outer surface of the disks 78. Screws 94 pass through openings in the cover plates and in the disks for securing the cover plates and disks onto the hub 70.

Operation of the perforator of the invention will now be described. A web 12 to be perforated is fed into the perforator 10 with the web entering and leaving the perforator in the relatively large space between the bottom of the inner drum 18 and the bottom of the outer drum 16. This large space results from the fact that the inner drum is significantly smaller in diameter than the outer drum. The large inner diameter of wall 36 provides easy access to the space within surface 22. Web 12 is threaded through the nip defined at the top of the inner and outer drums, and then leaves the perforator and crosses the entering portion of the web. Thus the portion of the web in the perforator is in the shape of a loop, and the entrance and exit portions of the web are not in contact so that the web is not scratched or otherwise damaged. The web can be driven into and pulled out of the perforator, or in some instances the force exerted on the web by the perforator will be sufficient to pull it into and drive it out of the perforator.

The entering portion of the web travels over the wall 36 and is guided by the tapered inner surfaces 38 into the position where it lies firmly against the inner surface of the die strip 24. This positioning is easily achieved with webs 12 of photographic film and other materials which have a tendency to return to their normal flat state. The spacing between the inner surfaces of wall 34 and 36 beside the web is substantially the same as the width of the web 12 so that the web is accurately positioned relative to the openings 26 in the die strip and the teeth 88 defining the punches on the inner drum.

The outer drum is driven by the drive mechanism coupled to the gear 46 on hub 44, thereby rotating the outer drum 16. As this occurs, the outer drum rotates the inner drum about the axis of shaft 64 due to the engagement of punches 88 in the die openings 32 in the outer drum. Once the web 12 is in the nip between the inner and outer drums, it is pulled through the nip by the punches and dies.

With the web 12 lying flat against the die strip 24, the punches 88 on the inner drum are driven through the side edge portions of the web to perforate the web. The portion of the web removed during formation of the perforation passes through the openings 32 in member 20. These perforations preferably are removed from the area of the perforator by suitable apparatus, not shown. When the dies 88 are withdrawn from the web the resulting perforated web is fed from the perforator by the force exerted on the web by the action of the punches and dies in the nip between the inner and outer drums.

Periodically the punches 88 and openings 26 defining the dies become worn and need to be replaced. Replacement is relatively easy with the apparatus of the present invention. More specifically, the dies are replaced by simply removing the die strip 24 and replacing it with a new die strip. The punches are easily replaced by removing the disks from the inner drum 18 and replacing them. This operation requires very little "downtime" and thus increases productivity of the perforator when compared with some prior perforating apparatus.

The invention has been described in detail with particular reference to a preferred embodiment thereof, but it will be understood that variations and modifications can be effected within the spirit and scope of the invention.

I claim:

1. A continuous motion perforator comprising:

a first drum having a cylindrical inner surface, a second drum having a generally cylindrical outer surface, the surface of the second drum having a diameter that is smaller than the diameter of the inner surface of the first drum, the second drum being positioned within the opening of the first drum with the axis of the surface of the second drum being offset from the axis of the surface of the first drum and with the surfaces located relative to each other to define a nip within the outer drum, a plurality of punches and dies located on the surfaces so that the punches can enter the dies in response to movement of the drums, means for effecting rotation of the drums in the same direction about their respective axes so that the punches enter the dies in response to rotation of the drums about their respective axes, whereby a web in the nip between the surfaces is perforated by the punches and dies.

2. A perforator as set forth in claim 1 wherein the first drum has first and second annular walls projecting radially inwardly form side edges of the cylindrical surface, the walls being separated by a distance substantially equal to the width of the web to be perforated to locate the web relative to the punches and dies.

3. A perforator as set forth in claim 2 wherein the first annular wall has a circular opening for the web to enter and leave the perforator, and the first annular wall has a tapered inner surface for guiding the web into the perforator and into contact with the inner surface of the first drum.

4. A perforator as set forth in claim 1 wherein the inner drum from has two spaced disks, and the punches are located on the disks.

5. A continuous motion perforator for film, paper or other elongate webs, the perforator comprising:

a first drum having a cylindrical inner surface;

a second drum having a cylindrical outer surface with a diameter smaller than the diameter of the inner surface of the first drum, the second drum being positioned within the first drum with the axis of the outer surface being offset from the axis of the inner surface, a portion of the outer surface being closely adjacent a portion of the inner surface to define a nip for receiving a web to be perforated, and the portions of the surfaces spaced from the nip being separated to provide a space for the web to be fed into and away from the nip of the perforator;

means mounting the drums for rotation about their respective axes;

a plurality of dies extending along the inner surface of the first drum;

a plurality of punches projecting from the outer surface of the second drum and adapted to enter the dies in the inner surface in the nip; and means for rotating one of the drums with the punches and dies jointly effecting simultaneous rotation of the other of the drums.

6. A perforator as set forth in claim 5 wherein the inner drum comprises a hub and an annular disk secured to the hub, the outer cylindrical surface being on the hub, and the punches comprising teeth projecting from the disk above the outer surface.

7. A perforator as set forth in claim 5 having an annular die member positioned on the outer drum and defining the inner cylindrical surface, the dies comprising a plurality of openings in the die member, the die member being easily removable from the outer drum for replacement when the dies become worn.

8. A perforator as set forth in claim 5 further comprising means on the outer drum for guiding a web between the inner surface and the outer surface so that the web can pass through the nip and be perforated.

9. A perforator as set forth in claim 5 wherein the inner drum has a hub, two annular disks on the hub, the disks being spaced apart in generally parallel planas, the punches being on the disks, and the hub having two annular raised edges adjacent the disks and separated by a recessed cylindrical surface with the raised edges being effective to support a center portion of the web above the cylindrical surface of the hub to avoid scratching off this portion of the web during perforation of the web.

* * * * *